United States Patent [19]

Eslinger

[11] Patent Number: 4,990,058

[45] Date of Patent: Feb. 5, 1991

[54] PUMPING APPARATUS AND PUMP CONTROL APPARATUS AND METHOD

[75] Inventor: David M. Eslinger, Duncan, Okla.

[73] Assignee: Haliburton Company, Duncan, Okla.

[21] Appl. No.: 442,031

[22] Filed: Nov. 28, 1989

[51] Int. Cl.[5] ..... F04B 49/00

[52] U.S. Cl. ..... 417/46; 417/18; 417/53

[58] Field of Search ..... 417/18, 46, 404, 53; 623/3; 60/911

[56] References Cited

U.S. PATENT DOCUMENTS

| | | | |
|---|---|---|---|
| 2,977,765 | 4/1961 | Fillmore | 60/911 |
| 3,966,358 | 6/1976 | Heimes et al. | 417/46 |
| 4,705,462 | 11/1987 | Balembois | 417/395 |

FOREIGN PATENT DOCUMENTS

| | | | |
|---|---|---|---|
| 0216075 | 10/1985 | Japan | 417/404 |

OTHER PUBLICATIONS

"Hydraulics & Pneumatics", May 1986, pp. 57 & 58.

*Primary Examiner*—Leonard E. Smith
*Assistant Examiner*—David W. Scheuermann
*Attorney, Agent, or Firm*—James R. Duzan; E. Harrison Gilbert, III

[57] ABSTRACT

A pumping apparatus comprises a fluid end cylinder carrying a double-acting piston which is reciprocated by a hydraulic servo actuator to provide an expanded flow range ability for metering fluids. The hydraulic servo actuator comprises: a hydraulic cylinder carrying a drive piston connected to the fluid end piston; a servo valve; a position transducer; and a microprocessor-based controller. The controller is programmed to accommodate accleration and deceleration of the extend and retract phases of a pump cycle to maintain constant average flow rate out of the fluid end. A control apparatus for controlling a pump and a related method are also disclosed.

17 Claims, 6 Drawing Sheets

PUMPING APPARATUS AND PUMP CONTROL APPARATUS AND METHOD

BACKGROUND OF THE INVENTION

This invention relates generally to pumping apparatus and to pump control apparatus and methods. The invention more particularly, but not by way of limitation, relates to an apparatus for operating a pump which includes a movable member whose position correlates with the fluid output of the pump. It also relates to a method of metering fluid at a selected flow rate with a pump which includes a fluid end member that is reciprocated through a pumping cycle in response to reciprocation of a power end member by a controlled volume of actuating fluid communicated to the power end member, which pumping cycle includes an extend phase during which the power end member displaces fluid across a first area and a retract phase during which the power end member displaces fluid across a second area.

In various industries different types of fluids need to be pumped at accurately controllable rates to produce desired blends of materials. In the oil and gas industry, for example, blends of carefully controlled amounts of fluids are made to produce fracturing fluids. A fracturing fluid is a mixture which is pumped down a well to fracture a subterranean formation to improve the flow of hydrocarbons from the formation into the well, thereby enhancing production of the well. A fracturing fluid contains one or more different additives such as buffers, crosslinkers, surfactants, clay stabilizers, friction reducers, liquid gel concentrates, liquid fluid loss materials and paraffin chemicals. These include organic acids (e.g., glacial acetic acid), petroleum-based fluids (e.g., diesel, kerosene), alcohols (e.g., methanol), solvents (e.g., xylene and toluene), mineral acids (hydrochloric acid), bases (e.g., sodium hydroxide) and amines. These liquid additives have different viscosities and typically need to be added in different quantities to produce a desired fracturing fluid. Therefore, they need to be metered by a pump at different metering or flow rates. By way of a specific example, the following are characteristics for the aforementioned chemicals in typical applications made by Halliburton Services, the Halliburton Company division which performs oil and gas well fracturing services:

| Flow Rate Range (gal/min) | Flow Rate Control Accuracy | Viscosity Range (cps at 70° F.) | Maximum Pressure (psi) | Fluid Temperature Range (°F.) |
|---|---|---|---|---|
| 0.05-52 | ±2% | 1-600 | 200 | additive pour point to 120 |

Metering pumps are used on fracturing equipment to accurately inject chemicals, such as those mentioned above, into the composite fracturing fluid. The design requirements for a general purpose fracturing service metering pump are very demanding because of the many types of chemicals pumped and the wide range of flow rates over which they are typically pumped. Currently, several different types of pumps are used to meter the different additives and to accommodate the different flow rates. These include gear pumps (e.g., ECO G-8), progressive cavity pumps (e.g., Roper 72292), peristaltic pumps (e.g., Waukesha SP-25) and single-acting simplex pumps (e.g., Milton-Roy MILROYAL C-4 7/16). These pumps typically have a limited maximum pressure capability (e.g., 50-200 psi), and limited flow rangeability or turn-down ratio (e.g., 5:1-100:1).

Although there are individual apparatus which can be used to pump certain ones of the additives at the desired flow rates in the specific example concerning the production of a fracturing fluid, there is no pumping apparatus currently available which will reliably meter, throughout a substantially encompassing flow rate range, all of the liquid additives identified above with acceptable accuracy. Therefore, there is the need for such an apparatus in at least the application of metering fracturing fluid additives. More specifically, there is the need for a pumping apparatus or a control apparatus or method for a pump which can satisfy substantially more of the specific pumping characteristics listed in the table above than an existing metering pump has been able to satisfy. It is further contemplated that such a versatile apparatus or method capable of pumping different fluids across a broad spectrum of viscosities and throughout a broad range of flow rates is needed in general. Such a pumping apparatus should also, of course, meet conventional pump characteristics such as pressure and temperature ranges at which the apparatus needs to be used. The fluid-end of such an apparatus should have good chemical compability and good suction characteristics for pumping additives from remote locations. The controls at the power end of such an apparatus should be adaptable for interfacing with other equipment and be packaged in a ruggedized enclosure, especially for the exemplary application in producing fracturing fluids.

SUMMARY OF THE INVENTION

The present invention overcomes the above-noted and other shortcomings of the prior art by providing a novel and improved pumping apparatus and pump control apparatus and method. These satisfy the aforementioned needs. That is, the present invention can accurately meter liquids over an extended flow range. With particular reference to the example of metering the aforementioned fracturing fluid liquid additives, a specific embodiment of the present invention can accurately meter liquid additives over the flow range of at least 0.025 to at least 20 gallons per minute. Such a specific embodiment has a fluid end which has good chemical compatibility and has good suction characteristics for pumping additives from locations remote from the pump. The power end controls can interface with other fracturing equipment and it can be packaged in a ruggedized enclosure.

The present invention provides an apparatus for pumping a fluid at a selected flow rate. This apparatus comprises: fluid end means for receiving and discharging the fluid; power end means, connected to the fluid end means, for operating the fluid end means; fluid communicating means for communicating a variable amount of an actuating fluid to the power end means; position detecting means for sensing a position of the power end means and for providing a signal in response thereto; and control means, responsive to the signal from the position detecting means and to a set point signal designating the selected flow rate, for operating the fluid communicating means to communicate actuating fluid to the power end means so that the power end means operates the fluid end means to discharge at the selected flow rate the fluid received in the fluid end means.

The present invention also provides an apparatus for operating a pump which includes a movable member whose position correlates with the fluid output of the pump. This apparatus comprises: means for receiving a set point signal designating a selected average flow rate at which fluid is desired to be output by the pump; means for receiving a pump feedback signal designating the position of the movable member of the pump; velocity and position profile generator means for generating a velocity signal and a position signal in response to the set point signal; and means for generating, in response to the velocity signal, the position signal and the pump feedback signal, a pump operation control signal.

The present invention also provides a method of operating a pump which includes a movable member whose position correlates with the fluid output of the pump. This method comprises the steps of: designating a selected flow rate at which fluid is desired to be output by the pump; identifying the position of the movable member of the pump; generating a velocity value and a position value in response to the designated flow rate; and generating, in response to the velocity value, the position value and the position of the movable member of the pump, a pump operation control signal.

The present invention also provides a method of metering fluid at a selected flow rate with a pump which includes a fluid end member that is reciprocated through a pumping cycle in response to reciprocation of a power end member by a controlled volume of actuating fluid communicated to the power end member, which pumping cycle includes an extend phase during which the power end member displaces fluid across a first area and a retract phase during which the power end member displaces fluid across a second area. The method comprises the steps of: (a) detecting the position of the power end member during its reciprocation; (b) computing a power end member velocity and a power end member position in response to the selected flow rate and in response to the relative time of the pumping cycle at which the pump is operating; and (c) controlling, in response to the computed velocity and position and the detected position, the volume of actuating fluid communicated to the power end member. In a preferred embodiment of this method, step (b) includes: computing the power end member velocity and the power end member position during an extend phase using a respective set of equations for each of an acceleration portion, a constant peak velocity portion and a deceleration portion of an extend phase and using a predetermined extend phase acceleration factor in the equations; and computing the power end member velocity and the power end member position during a retract phase using a respective set of equations for each of an acceleration portion, a constant peak velocity portion and a deceleration portion of the retract phase and using a predetermined retract phase acceleration factor in the equations.

Therefore, from the foregoing, it is a general object of the present invention to provide a novel and improved pumping apparatus and pump control apparatus and method. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 3 is a functional block diagram of a controller and servo valve of the pumping apparatus.

FIG. 6 is a detailed block diagram of the control methodology for the pumping apparatus.

DETAILED DESCRIPTION OF THE PREFERRED EMBODIMENTS

Figure 1:
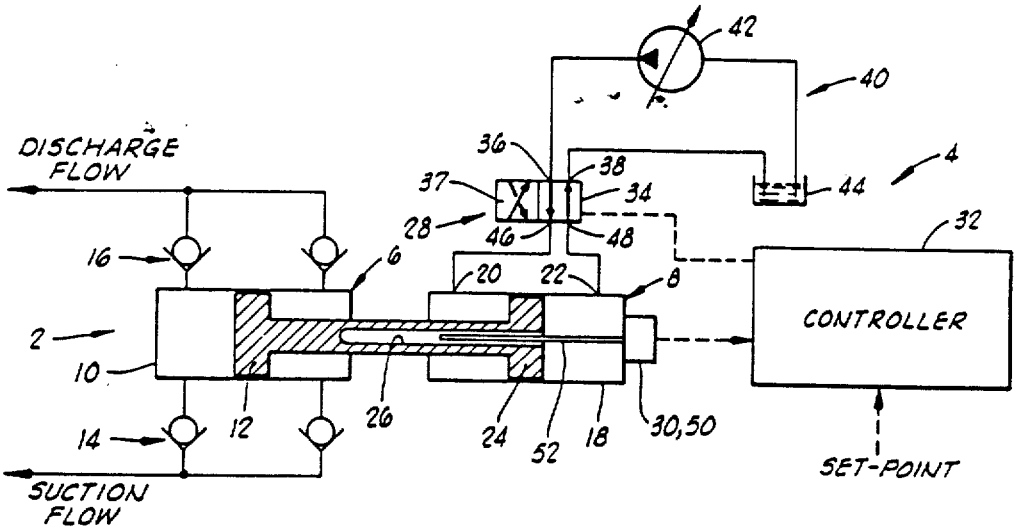
FIG. 1 is a schematic block diagram of a pumping apparatus of a preferred embodiment of the present invention.
Figure 2:
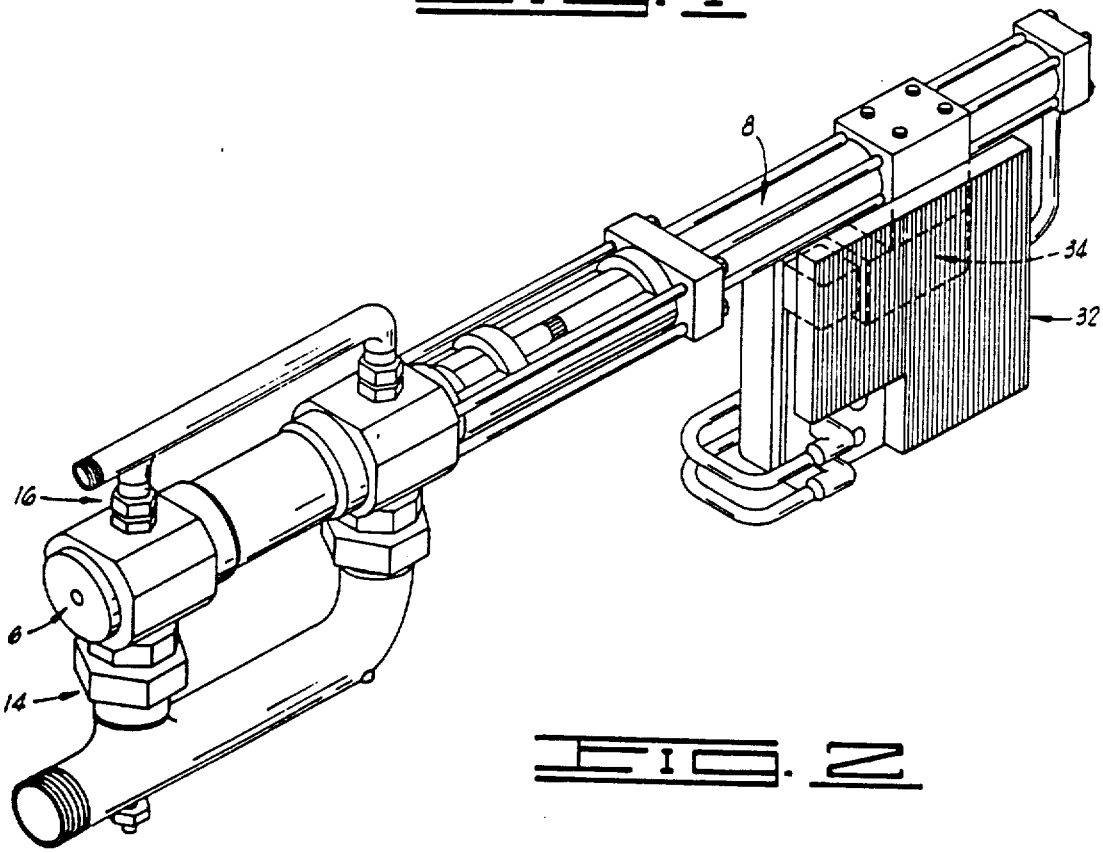
FIG. 2 is a perspective view of a particular implementation of the preferred embodiment of the pumping apparatus shown in FIG. 1.

FIG. 1 schematically illustrates a preferred embodiment of the present invention's pumping apparatus for pumping a fluid at a selected flow rate. A specific implementation of the pumping apparatus is illustrated in FIG. 2, wherein like features are identified by the same reference numerals used in FIG. 1.

The pumping apparatus includes a fluid driving apparatus 2 by which the fluid to be pumped is received and discharged. The fluid driving apparatus 2 is referred to herein as the pump of the overall pumping apparatus depicted in FIG. 1. The pumping apparatus also includes a control apparatus 4 for operating the pump 2.

The fluid driving apparatus 2 includes fluid end means 6 for receiving and discharging the fluid. The fluid driving apparatus 2 also includes power end means 8, connected to the fluid end means 6, for operating the fluid end means 6.

As depicted in FIG. 1, the fluid end means 6 includes a fluid end cylinder 10. A fluid end piston 12 is disposed for reciprocating movement within the cylinder 10. The piston 12 is a double-acting piston. It is moved to draw in the fluid to be pumped through suction valves 14 and to discharge such received fluid through discharge valves 16. These components may be of conventional types.

A specific implementation of the fluid end means 6 is contained within the embodiment illustrated in FIG. 2, which embodiment is adapted for use in metering various types of liquid additives needed in producing a suitable fracturing fluid. The implementation shown in FIG. 2 is specified to provide a flow within the flow rate range from about 0.40 gallons per minute (gpm) to about 20 gpm (flow rangeability, or turn-down ratio of 50:1); however, it has been tested to accurately meter fluids within a viscosity range of 1 to 600 centipoise (cp) within the range from about 0.025 gpm to about 20 gpm with $\pm 2\%$ accuracy (turn-down ratio $=800:1$). This accomplishes, with the single pump illustrated in FIG. 2, most of the metering referred to hereinabove with reference to fracturing fluids. For the typically rare jobs when one of the additives, such as a liquid gel concentrate, might need to be metered up to the 52 gpm upper limit listed in the table set forth hereinabove, two or more of the pumps illustrated in FIG. 2 would be used.

For the FIG. 2 implementation, the piston 12 has a nominal diameter of 2.75 inches, and the rod extending therefrom has a nominal diameter of 1.375 inches. The stroke length is 8.89 inches. The maximum pump cyclic speed is 50 cycles per minute (cpm), and the fluid end design pressure at 3000 pounds per square inch (psi) hydraulic pressure is 1500 psi.

The fluid end of the FIG. 2 embodiment is a double-acting piston type with standard API balls and seats in the discharge and suction valves. The suction valves are designed to provide minimal resistance to flow to enhance pump suction characteristics. The discharge valves are preloaded to provide a minimum of 15 psi cracking pressure to prevent uncontrolled flow through the pump with a high suction head.

All static and dynamic seals have acceptable chemical resistance to all liquid additives. The dynamic seal surfaces (rod and liner) are ceramic for excellent chemical resistance and long wear life. The piston and rod dynamic seals are spring-loaded Parker PolyPak seals modified by a cavity extending inwardly from the normal opening to produce increased flexibility and high squeeze with relatively low wear.

The fluid end is designed to minimize unswept volume for improved metering accuracy when pumping at high pressure or with aerated fluids. The displaced volume per stroke is 80% of the total fluid end volume.

Referring again to FIG. 1, the power end means 8 of the fluid driving apparatus 2 includes a power end cylinder 18 which has two ports 20, 22 defined therein. The cylinder 18 also has a power end piston 24 disposed for reciprocating movement therein. In the embodiment shown in FIG. 1, the piston 24 is a double-acting piston from which a rod extends in a conventional manner and couples with or is integrally formed with the rod extending from the fluid end piston 12. The piston 24 and its portion of the interconnecting rod have a cavity 26 defined therein as schematically shown in FIG. 1. As with the fluid end components, the power end components can be conventional.

For the FIG. 2 implementation, the piston 24 has a nominal cross section of two inches, and the rod has a nominal cross section of one inch. The stroke is nine inches. The seals are preferably low friction. High rod load is not a primary design consideration in the FIG. 2 implementation; therefore, the cylinder size is minimized to reduce hydraulic flow rate requirements. The 2-inch bore and 1-inch rod are the smallest available for mounting a position transducer to be subsequently described inside the cylinder rod. The cylinder 18 is pressure rated to only 2000 psi because of the low column buckling strength of the hollow rod.

In the preferred embodiment, the power end means 8 in combination with the control apparatus 4 may be referred to as a hydraulic servo-actuator which accurately controls the velocity and position of the piston 12 in the double-acting fluid end. The hydraulic servo-actuator provides closed loop control and compensates for acceleration and deceleration which occur in the extending and retracting movements of the coupled power end and fluid end pistons so that fluid is pumped by the fluid end at a constant average flow rate from within an expanded range of possible flow rates.

In addition to the power end means 8, the hydraulic servo-actuator includes the control apparatus 4 which comprises: fluid communicating means 28 for communicating a variable amount of an actuating fluid to the power end means 8; position detecting means 30 for sensing a position of the power end means 8 and for providing a signal in response thereto; and control means 32, responsive to the signal from the position detecting means 30 and to a set point signal designating a selected flow rate, for operating the fluid communicating means 28 to communicate actuating fluid to the power end means 8 so that the power end means 8 operates the fluid end means 6 to discharge at the selected flow rate the fluid received in the fluid end means 6. These are implemented to effect closed-loop control of the velocity and position of power end piston 24 which in turn controls the velocity and position of the fluid end piston 12. Although closed-loop control of a hydraulic cylinder alone and in general is known, the overall apparatus and methodology described and claimed herein are believed to be novel and non-obvious.

The fluid communicating means 28 is implemented in the preferred embodiment by a servo valve 34 which includes a stepper motor 35 (FIG. 3) which responds to the control means 32 to move a valve member 37 in a known manner. The servo valve 34 depicted in FIG. 1 includes two ports 36, 38 for communicating with a source 40 of actuating fluid. The source 40 includes a hydraulic pump 42 for pumping a conventional actuating hydraulic fluid from a reservoir 44. An accumulator (not shown) may be required in the source 40 because of the interruption in flow which occurs at the turnaround positions of the piston 24. This would be necessary if the pressure compensator of the hydraulic pump 42 is not responsive enough to cause the pump delivery to follow the desired flow rate profile.

The servo valve 34 also has two ports 46, 48. The two ports 46, 48 are connected to the two ports 20, 22, respectively, of the power end cylinder 18.

The hydraulic servo valve 34 provides accurate metering of oil or other suitable fluid to the cylinder 18 to control piston velocity in response to a command signal from the control means 32. Following are the primary factors considered in selecting a servo valve for the power end implementation of FIG. 2:

valve should have adequate frequency response to provide good control at an actuator frequency of 0.8 Hertz (50 cpm);

valve should have minimum deadband, or null overlap to prevent large error at the piston turnaround positions;

valve should have sufficient dirt tolerance to allow reliable operation under field operating conditions;

valve should require approximately 1000 psi pressure drop at rated valve flow (low valve pressure drop makes the system too sensitive to variations in pump discharge pressure and increases valve size; high valve pressure drop causes high horsepower loss); and valve electrical power requirements should be low.

A further system related preference is that the valve should include a valve controller which will interface with other equipment and which also is microprocessor based to allow custom programming of the desired piston velocity and position profiles.

An appropriate servo valve is the Olsen-DSNV-C02-030 from Olsen Controls. The Olsen valve is a single stage, digital servo valve. A zero overlap spool is positioned axially by a DC stepping motor and a rotary-to-linear coupling to control flow through the valve.

Referring again to FIG. 1, the position detecting means 30 of the control apparatus 4 includes in the preferred embodiment a magnetostrictive position transducer 50, but other similar devices such as linear potentiometers can be used. The transducer 50 is mounted on the power end cylinder 18, and it is also connected to the control means 32 to enable an electrical signal generated by the position transducer 50 to be communicated to the control means 32. The signal generated by the position transducer 50 may be referred to as a pump feedback signal in that it is the signal used by the control means 32 to detect or identify the position of the piston 24 within the cylinder 18. The position transducer 50 includes a member 52 which extends inside the cylinder 18 and within the cavity 26 of the piston 24 and its rod. The relative movement between the piston 24 and the member 52 defines the pump feedback signal to be generated. In the implementation shown in FIG. 2, the transducer 50 is implemented by a Balluff Model BTL-E10-0230-Z transducer.

The control means 32 generally includes means for controlling the fluid communicating means 28 so that the pump 2 is operable over an extended range of flow rates. In a preferred embodiment the fluid communicating means 28 is controlled so that the power end means 8 operates the fluid end means 6 to discharge the fluid within a range between a low discharge flow rate and a high discharge flow rate, wherein the ratio between the high discharge flow rate and the low discharge flow rate is about 50:1. More preferably, this ratio is at least approximately 800:1. For the particular implementation illustrated in FIG. 2, the pump 2 is operable to accurately meter a fluid having a viscosity within the range from about 1 cp to about 600 cp at a flow rate within the range from about 0.025 gpm to about 20.0 gpm with ±2% accuracy. A particular specified range for the implementation shown in FIG. 2 is 0.40 gpm to 20.0 gpm.

The extended flow rangeability is accomplished in the preferred embodiment with an implementation of the control means 32 including computer means for computing a velocity value and a position value in response to the selected flow rate and for processing the velocity value, the position value and the signal from the position detecting means 30 in response to a predetermined closed-loop proportional gain, a predetermined closed-loop integral gain and a predetermined open-loop feed-forward loop gain to produce a signal for operating the fluid communicating means 28. This is specifically implemented by a programmed microcomputer controller connected to respond to the transducer 50 and to operate the servo valve 34.

In the FIG. 2 implementation, the controller receives a 4–20 mA flow rate set point from an external data entry device, such as a keyboard, keypad or peripheral equipment (e.g., a blender unit controller used in producing a fracturing fluid). This signal can be updated every 100 milliseconds. Based on the set point, the controller calculates the piston 24 velocity and position profiles and once per millisecond sends a command to the servo valve 34 to open the amount expected to cause the piston 24 to move at the calculated velocity. The piston position transducer 50 continuously monitors the actual piston position and updates the controller every 4 milliseconds. The commanded and actual piston positions are used in a PI (proportional-integral) closed-loop control scheme in the controller to achieve the desired velocity and position profiles. Closed-loop control of the servo-actuator automatically compensates for variations in fluid end discharge pressure, hydraulic oil pressure, oil viscosity, and cylinder volumetric efficiency.

FIG. 3 shows a functional block diagram of an Olsen 3051 based controller having the known components shown in the drawing. The controller has the following custom features:

all components are industrial grade with −50° to +185° F. temperature range except the L298 stepping motor driver ("micro-step valve driver") which has an upper temperature limit of 158° F.;

all components are soldered to the printed circuit board;

wire jumpers are used in place of pin jumpers and dip switches; and wire leads are used in place of connectors.

Command and feedback communication to the Olsen controller are to 10-bit (1024 bits) analog-to-digital converters. Since both analog signals are 4–20 mA current loops only the top 80% of the range is used so that the maximum precision for the command and feedback signals is one part in 819.

The Olsen controller has one digital output which is pulled high to 5VDC to signal a fault condition. Following are conditions which cause a fault:

watch-dog timer time-out;

excess position loop error limit exceeds predefined limit;

improper syntax in command or transmission error;

input buffer overflow; and external RAM corrupted.

All of the faults except corruption of the external RAM will cause the controller to automatically stop and restart with a delay of approximately 150 milliseconds. The fault line will be briefly pulled high during automatic restart. It is the responsibility of the unit operator to determine if the controller is restarting too frequently and should be shut down for inspection. If the external RAM is corrupted, then the controller will not restart since important constants in the software may have been changed by lightning discharge, etc. Resetting the constants requires entering an RV! command via the RS-232 port using a handheld terminal.

The software for the Olsen controller is a modified version of the standard software provided by Olsen. Custom programming was done by Olsen for the FIG. 2 implementation to implement the desired piston velocity profiles and the control algorithm described hereinbelow. The software was further modified to improve stepper motor stability, provide for automatic restart after a fault, and to provide for operation with a square velocity profile.

Following are the primary features of the Olsen controller software:

piston velocity profiles implemented; profile will change in mid-stroke if command signal is changed;

control algorithm uses closed-loop proportionalintegral scheme and an open-loop feed-forward scheme;

automatic system restart (AU) after a fault provides for robust operation in the presence of noise, etc.;

error handling feature allows operator to interrogate controller to determine cause of a fault;

modified range command allows the FIG. 2 pump to be reconfigured by dividing normal flow rate by eight; this feature allows pump to have much greater precision at low flow rates (1bit =0.003 gpm instead of 1 bit =0.0244 gpm); and square wave velocity feature allows pump to be configured to have instantaneous piston acceleration.

Figure 4:
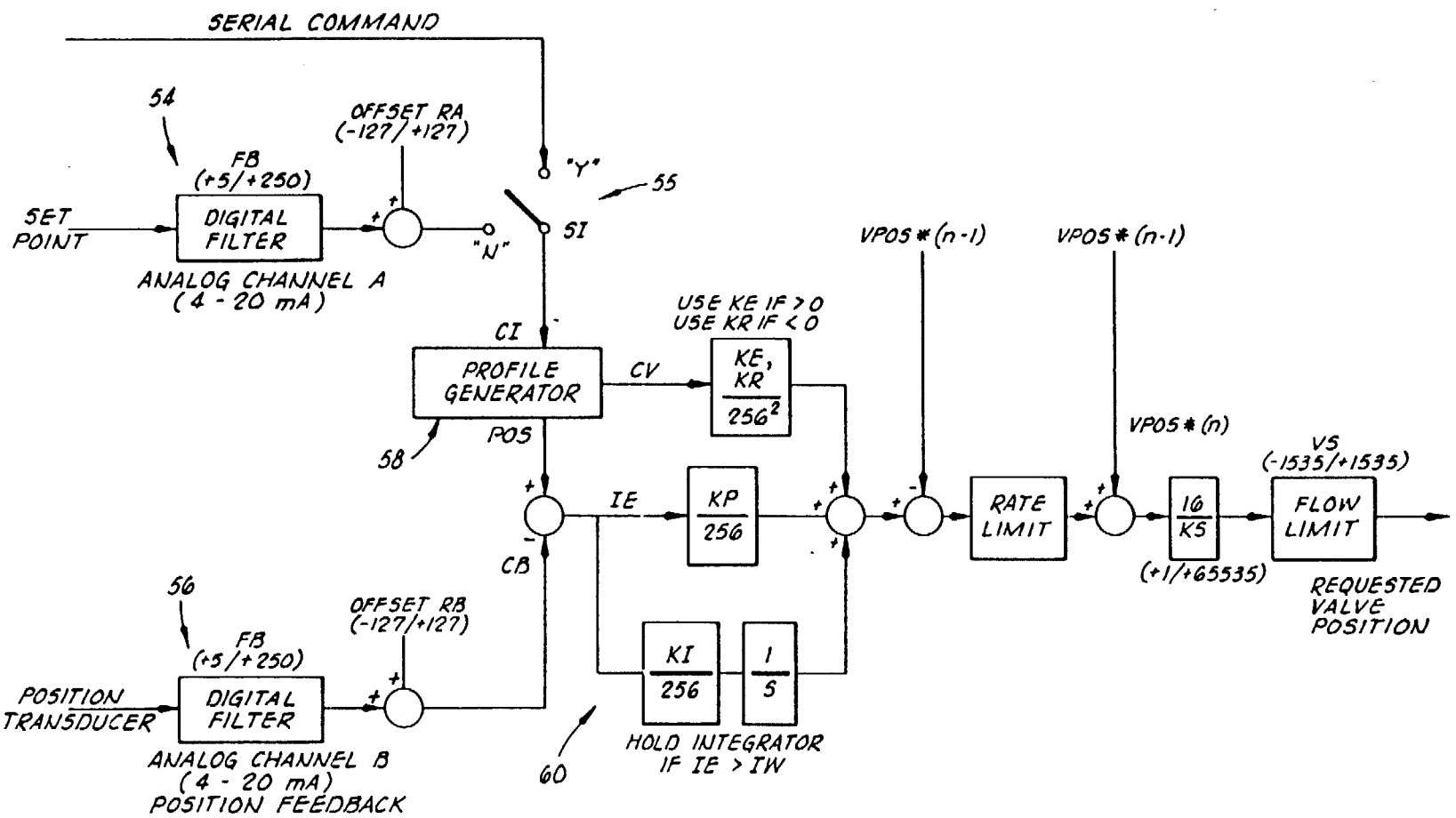
FIG. 4 is a block diagram of control methodology carried out in the controller to control the servo valve.
Figure 5:
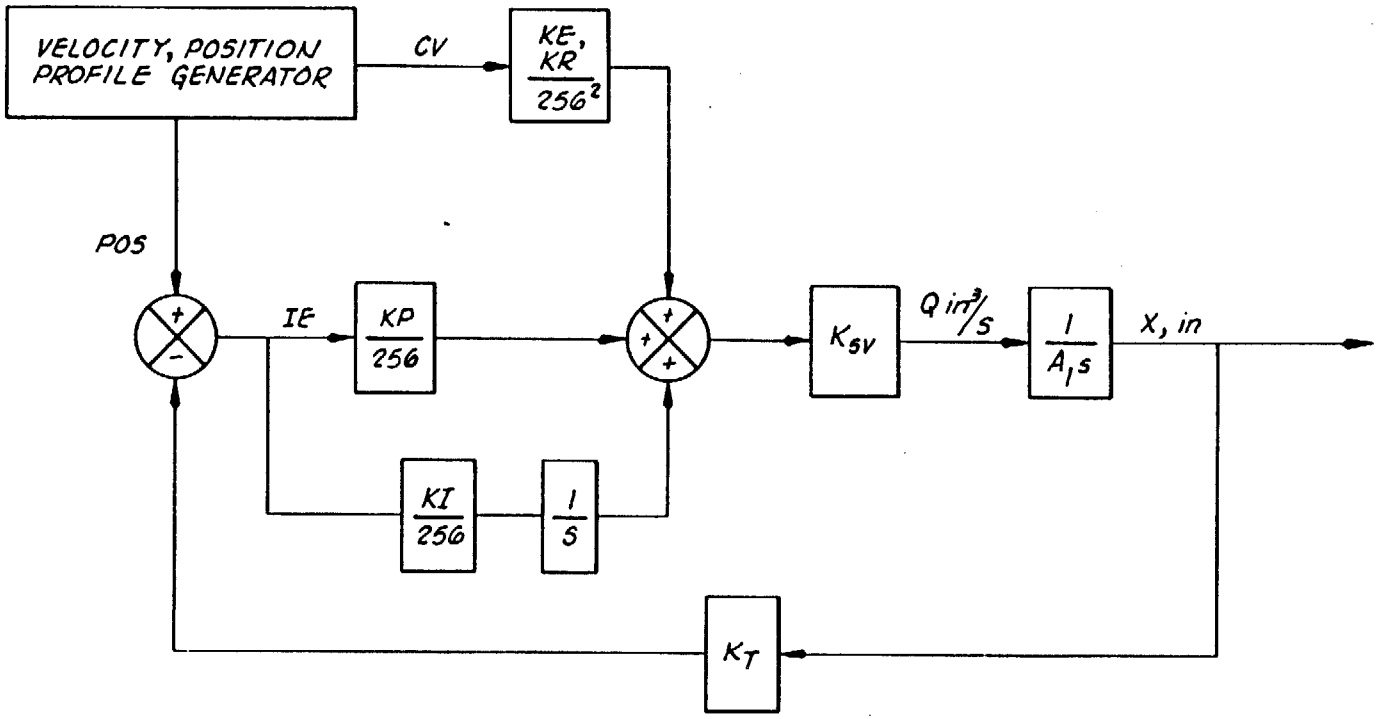
Figure 5:
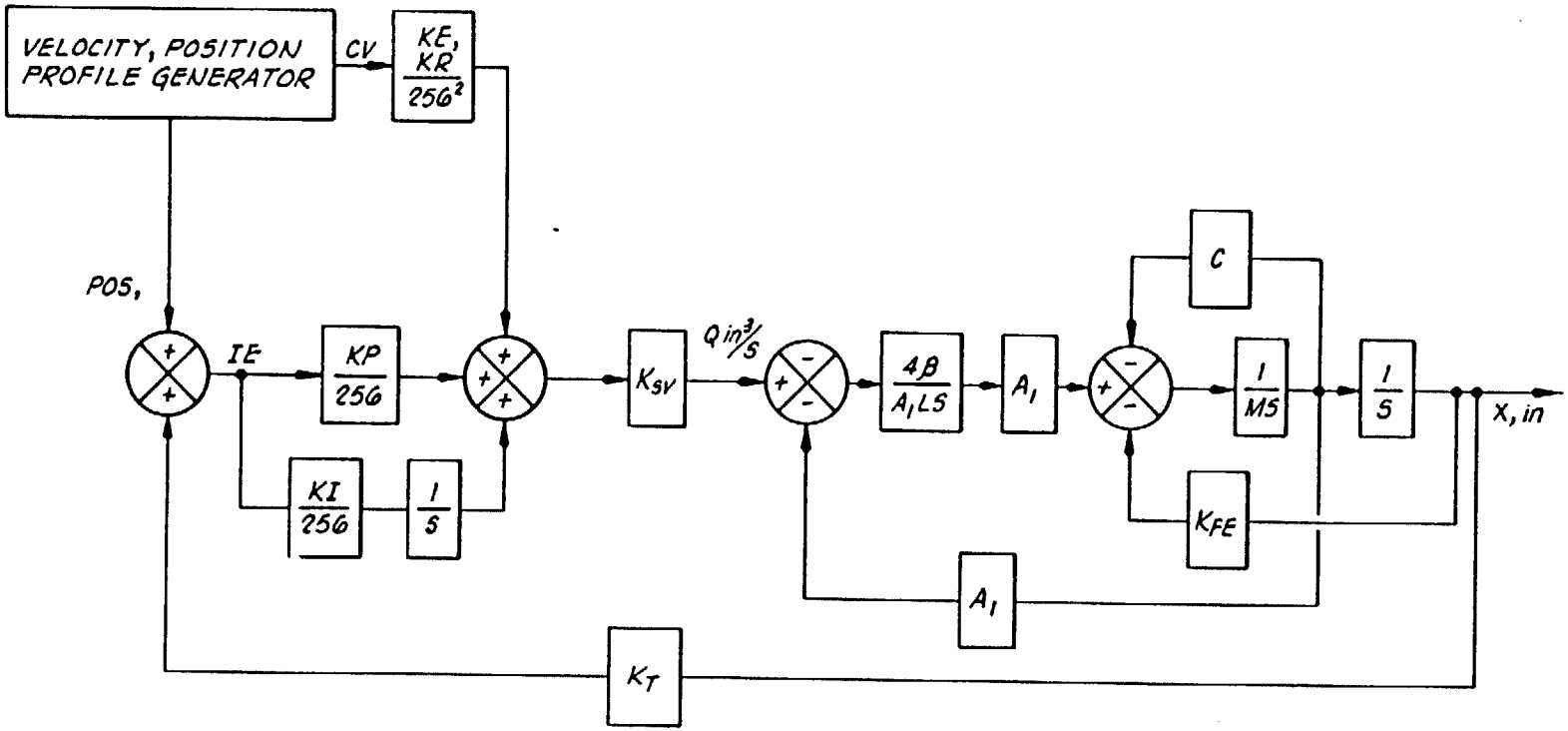

FIG. 4 shows a block diagram of the software control scheme for controlling the servo valve 34. Task scheduling is organized as follows:

every 1 msec the servo valve stepping motor position is updated;

every 4 msec the piston 24 position (analog channel B) is sampled and the control algorithm is calculated based on the actual and desired piston 24 positions; and every 32 msec the analog command (set point) signal (analog channel A) is sampled and a new velocity and position profile are calculated (a command signal change of 0.0105 mA causes a 1-bit digital change in the software which causes a 0.0244 gpm change in pump flow rate).

The microcomputer and the program define the following means which are described with reference to FIG. 4. From this description, a method of operating a pump which includes a movable member whose position correlates with the fluid output of the pump will also become apparent. The programmed microcomputer implemented means include: means 54 for receiving a set point signal designating a selected average flow rate at which fluid is desired to be output by the pump 2; means 56 for receiving a pump feedback signal designating the position of the movable member (specifically, the piston 24 in the FIG. 1 embodiment) of the pump 2; velocity and position profile generator means 58 for generating a velocity signal and a position signal in response to the set point signal; and means 60 for generating, in response to the velocity signal, the position signal and the pump feedback signal, a pump operation control signal.

As shown in FIG. 4, the means 54 includes a conventional 4–20 mA analog channel connected to a conventional data input device (not shown) through which the desired set point flow rate information can be input into the microcomputer. A serial command input can be input in lieu of the set point via a switch 55. Whichever input is used, it is identified as the command input (CI).

The means 56 includes a conventional 4–20 mA analog channel connected to receive the output from the transducer 50 and communicate it to the microcomputer.

The velocity and position profile generator means 58 is the means which achieves the constant average flow rate despite the acceleration and deceleration which occur in each extend and retract phase of a reciprocating pump cycle. In the preferred embodiment, the profile generator means 58 broadly includes means for computing a velocity value and a position value in response to a predetermined acceleration value and for outputting the velocity signal and the position signal in response thereto. These are implemented through computations performed within the microcomputer. These computations and their derivation will next be described.

Following are the predetermined considerations forming the basis of the velocity and flow rate profiles for the FIG. 2 implementation of the present invention depicted in FIG. 1:

suction retract stroke acceleration time, $t_r^r$ of 0.180 seconds (modeling suction flow through the pump as a lumped fluid inertance and fluid resistance to determine the maximum piston acceleration allowed to prevent cavitation produced the result that when pumping LGC-5 at 20 gpm, full suction flow of 158 $in^3/sec$ would be achieved in 0.126 sec; to give adequate operating margin, a velocity ramp time of 0.180 sec at 20 gpm was selected—see Appendix for equations);

average flow rate in extend and retract directions should be equal;

peak flow rate in extend and retract directions should be equal; and pump cyclic speed, n, at 20 gpm is 50 cpm. Based on the foregoing predetermined considerations and a specific construction of the pump 2, constant acceleration parameters for the extend and retract phases must be computed and preset for subsequent use by the controller 32 in computing real-time control signals. This will be explained with reference to the pumping cycle illustrated in FIG. 7 and the design specifications given hereinabove for the specific FIG. 2 implementation.

Figure 7:
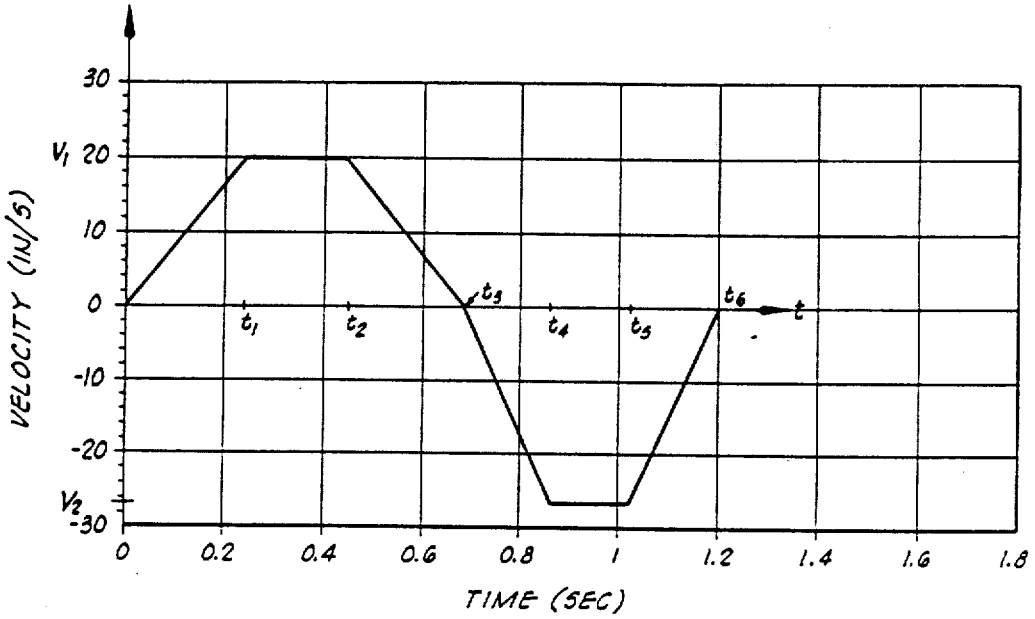
FIG. 7 is a graphical general velocity profile for a pumping cycle of the pumping apparatus.

Referring to FIG. 7, the period of the pump cycle $t_6$ is, $$t_6 = 60/n \text{ sec} \tag{1}$$

The time for the extend and retract stroke of the piston 24 is in proportion to the ratio of the displacements in each direction to the total displacement. The extend time is:

$$t_3 = \frac{A_1}{A_1 + A_2} t_6 \text{ sec} \tag{2}$$

where, $A_1$ = piston 24 area $= 2^2\lambda/4$ $in^2$ $A_2$ = rod end area of piston 24 $= (2^2 - 1^2)\lambda/4$ $in^2$ $$t_3 = 4/7\ t_6 \text{ sec} \tag{3}$$

The retract time is $$t_6 - t_3 = \frac{A_2}{A_1 + A_2} t_6 \text{ sec} \tag{4}$$

$$t_6 - t_3 = 3/7\ t_6 \text{ sec} \tag{5}$$

The constant acceleration during extend, $a_1$, is:

$$a_1 = \frac{V_1}{t_r^e} \text{ in}/s^2 \tag{6}$$

where, $V_1$ = peak extend velocity $t_r$ = extend acceleration time $$V_1 = \frac{V_1}{\left(\frac{t_3 - t_r^e}{t_3}\right)} \text{ in}/s \tag{7}$$

where, $\overline{V}_1$ = average extend velocity $$t_r^e = t_r^r \times \frac{A_1}{A_2} = 0.24 \text{ sec} \tag{8}$$

At 20 gpm, $$V_1 = \frac{20 \text{ gpm} \times \frac{231 \text{ in}^3/\text{gal}}{60 \text{ s/min}}}{2.75^2 \text{ in}^2\ \pi/4} = 12.97 \text{ in}/s \tag{9}$$

$$a_1 = 83.1 \text{ in}/s^2 \tag{10}$$

The constant acceleration during retract, $a_2$, is:

$$a_2 = \frac{V_2}{t_r'} \text{ in/s}^2$$

where, $V_2$=peak retract velocity $t_r$=retract acceleration time=0.18 sec (see predetermined considerations above and the Appendix)

$$V_2 = \frac{V_2}{\left(\frac{t_6 - t_3 - t_r'}{t_6 - t_3}\right)} \tag{11}$$

where, $\bar{V}_2$=average retract velocity at 20 gpm, $$V_2 = \frac{20 \text{ gpm} \times \frac{231 \text{ in}^3/\text{gal}}{60 \text{ s/min}}}{(2.75^2 - 1.375^2)\text{in}^2\ \pi/4} = 17.28 \text{ in/s} \tag{12}$$

$$a_2 = 147.74 \text{ in/s}^2 \tag{13}$$

Once $a_1$ and $a_2$ have been established, they are used by the controller 32 in the following generalized (i.e., not related to a specific flow rate as the foregoing calculations were) equations defining the velocity and position profile generator.

The peak velocity during retract, $V_2$, at pump speed, n (corresponding to the entered set point flow rate), for the design criteria of the specific FIG. 2 implementation is computed using Equation 14.

$$V_2(\text{in/s}) = \frac{1 - \sqrt{1 - 4\left(\frac{7}{3a_2t_6}\right)\left(\frac{20 \times 231 \times n}{\pi/4(2.75^2 - 1.375^2) \times 50 \times 60}\right)}}{\left(\frac{14}{3a_2t_6}\right)} \tag{14}$$

The peak velocity during extend, $V_1$, at pump speed, n (corresponding to the entered set point flow rate), for the design criteria of the specific FIG. 2 implementation is computed using Equation 15.

$$V_1(\text{in/s}) = \frac{1 - \sqrt{1 - 4\left(\frac{7}{4a_1t_6}\right)\left(\frac{20 \times 231 \times n}{\pi/4(2.75^2) \times 50 \times 60}\right)}}{\left(\frac{14}{4a_1t_6}\right)} \tag{15}$$

Referring to FIG. 7, the inflection points in the actuator position and velocity profiles are calculated using Equations 16–20.

$$t_1(\text{sec}) = \frac{V_1}{a_1} \tag{16}$$

$$t_2(\text{sec}) = 4/7t_6 - t_1 \tag{17}$$

$$t_3(\text{sec}) = 4/7t_6 \tag{18}$$

$$t_4(\text{sec}) = 4/7t_6 + \frac{V_2}{a_2} \tag{19}$$

-continued $$t_5(\text{sec}) = t_6 - \frac{V_2}{a_2} \tag{20}$$

For the time interval $0<t\leqq t_1$, the actuator velocity and position are calculated using Equations 21 and 22.

$$V(in/s) = a_1t \tag{21}$$

$$X(in) = \frac{a_1}{2}t^2 \tag{22}$$

For the time interval $t_1<t\leqq t_2$, the actuator velocity and position are calculated using Equations 23 and 24.

$$V(in/s) = a_1t_1 \tag{23}$$

$$X(in) = \frac{a_1}{2}t_1^2 + a_1t_1(t - t_1) \tag{24}$$

For the time interval $t_2<t\leqq t_3$, the actuator velocity and position are calculated using Equations 25 and 26. The total stroke is calculated using Equation 27.

$$V(in/s) = a_1t_1 - a_1(t - t_2) \tag{25}$$

$$X(in) = \frac{a_1}{2}t_1^2 + a_1t_1(t_2 - t_1) + a_1t_1(t - t_2) - \frac{a_1}{2}(t - t_2)^2 \tag{26}$$

$$S(in) = \frac{a_1}{2}t_1^2 + a_1t_1(t_2 - t_1) + a_1t_1(t_3 - t_2) - \frac{a_1}{2}(t_3 - t_2)^2 \tag{27}$$

For the time interval $t_3<t\leqq t_4$, the actuator velocity and position are calculated using Equations 28 and 29.

$$V(in/s) = -a_2(t - t_3)^2 \tag{28}$$

$$X(in) = S - \frac{a_2}{2}(t - t_3)^2 \tag{29}$$

For the time interval $t_4<t\leqq t_5$, the actuator velocity and position are calculated using Equations 30 and 31.

$$V(in/s) = -a_2(t_4 - t_3) \tag{30}$$

$$X(in) = S - \frac{a_2}{2}(t_4 - t_3)^2 - a_2(t_4 - t_3)(t - t_4) \tag{31}$$

For the time interval $t_5<t\leqq t_6$, the actuator velocity and position are calculated using Equations 32 and 33.

$$V(in/s) = -a_2(t_4 - t_3) + a_2(t - t_5) \tag{32}$$

$$X(in) = S - \frac{a_2}{2}(t_4 - t_3)^2 - a_2(t_4 - t_3)(t_5 - t_4) - a_2(t_4 - t_3)(t - t_5) + \frac{a_2}{2}(t - t_5)^2 \tag{33}$$

As shown in FIG. 4, once a velocity value and a position value are computed in the profile generator 58 based upon the time in the pumping cycle (which is determined from the position feedback signal from the transducer 50) and the foregoing equations 14–33, the values are processed through the computer implemented means 60 from which the pump operation control signal is generated and communicated to the servo valve 34 (specifically the stepping motor 35) so that the pump output flow rate is thereby controlled. The means 60 in general provides a combination of conventional closedloop and openloop gains. This will be described with reference to the expanded depiction shown in FIGS. 5 and 6.

Figure 5:
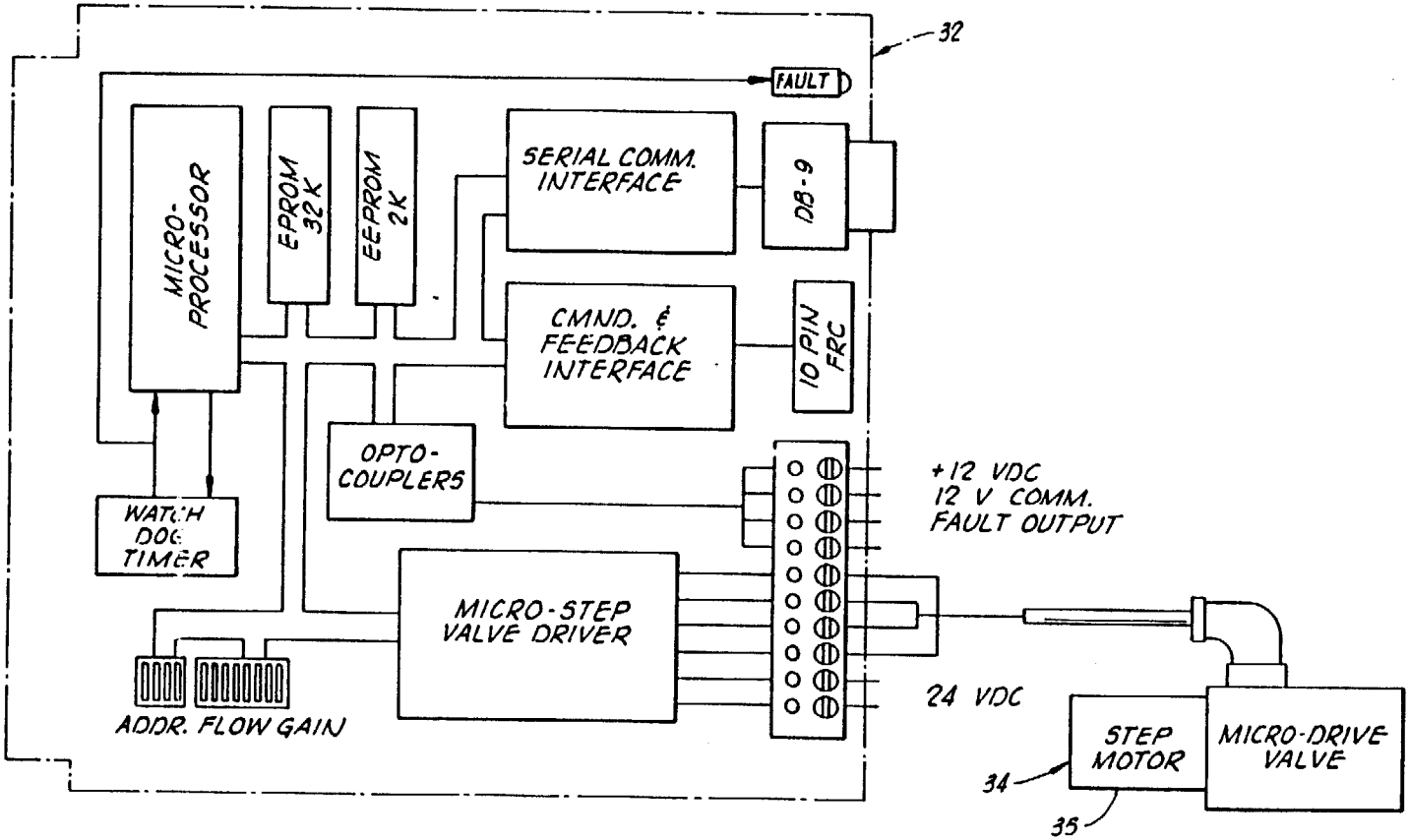
FIG. 5 is a simplified block diagram of the control methodology for the pumping apparatus.

FIG. 6 shows the complete block diagram for the FIG. 2 pump controls analysis. If the pump resonant frequency $\omega_n$ is more than three times the servo valve natural frequency, then the block diagram can be simplified as shown in FIG. 5. The pump natural frequency, $\omega_n$ is given by $$\omega_n = \sqrt{\frac{4\beta A_1}{LM} + \frac{K_{FE}}{M}} \text{ rad/sec} \quad (34)$$

where, $\beta$, hydraulic fluid bulk modulus = 150,000 psi

L, stroke = 8.89-inches $A_1$, hydraulic cylinder area = 2.36-inch$^2$

M, lumped pump reciprocating mass = 15/386 lb msec$^2$/in $K_{FE}$, overall fluid end stiffness, lbs/in $$K_{FE} = \frac{K_f K_{rod}}{K_f + K_{rod}} \quad (35)$$

$$K_f = \frac{\beta A_2}{L/2}$$

where, $A_2$ = fluid end cylinder area, = 4.45-in$^2$ $$K_{rod} = \frac{A_{rod} E}{L_{rod}}$$

where, $A_{rod}$ = 0.79 inch$^2$ $L_{rod}$ = 11 inches

E, modulus elasticity of rod material = $30 \times 10^6$ psi

Substituting parameter values into Equation 35

$K_{FE}$ = 133,000 lb/in

Substituting parameter values into Equation 34, $\omega_n$ = 2,730 rad/sec $f_n$ = 430 Hz Therefore, the pump resonant frequency of 430 Hz is approximately 100 times greater than the 3Hz break frequency of the servo valve.

The break frequency of the Olsen servo valve is determined by the stepping motor stop-start torque vs. speed curve. This curve is essentially flat up to a motor step rate of approximately 1000 prime steps/second (32,000 microsteps/second). This maximum step rate corresponds to a valve cycle rate of approximately 3 Hz for full spool movement (±0.048-inch).

The pump control system will be stable if the control loop gain does not exceed 18.8 rad/sec.

$$K_{Loop} \leqq \omega_{sv} = \frac{3rev}{sec} \times 2\pi \frac{rad}{rev} = 18.8 \text{ rad/sec} \quad (36)$$

where, $\omega_{sv}$ = natural frequency of servo valve, rad/sec

If the feed forward and integral gains are neglected for the pump control system shown in FIG. 6, then the loop gain is $$K_{Loop} = \frac{K_p, \text{ bits}}{256} \times K_{sv} \times \frac{1}{A_1} \times K_t$$

Substituting parameter values into Equation 36 gives, $$K_{Loop} = .0115\, K_p$$

$$K_p \leqq \frac{18.8 \text{ rad/s}}{.0115 \text{ rad/s}} \leqq 1630$$

The actual closed loop proportional gain selected empirically was 1400.

In addition to the closed loop proportional gain, a closed loop integral gain and an open-loop feed-forward loop are used to improve system performance. Integral compensation is used to reduce the steady state position error to zero by accumulating the following error over time and multiplying the sum by an integral gain. An integrator window (IW) is used to prevent excessive error windup in the control system which could cause instability.

A feed-forward loop is used to cause a control signal to the servo valve based on calculated piston velocity rather than on loop position error. This method effectively reduces following error by reducing the error signal required to cause a given output signal to the servo valve. The feed-forward loop is open; therefore, it is inherently stable. If the feed-forward gains KE and KR are greater than the closed loop gains (KP and KI) then the controller will be inherently stable.

The loop gains, KE, KR, KP, and KE were empirically determined by using the following procedure:

adjust KE and KR to give good open loop control at mid-speed with KI and KP set to zero;

adjust KP to minimize loop error at high speed; and adjust KI to minimize loop error without causing overshoot at turnaround.

Relatively high closed loop gains cause the piston to have a stepping motion at very slow speeds. Therefore, the normal proportional gain, KP, is reduced by one-half at speeds below 300/819 (0.366) of the maximum speed.

Following are empirically determined controller gains used in the described particular implementation of FIG. 2:

| | |
|---|---|
| KP, proportional gain = | 1400 for CI >300<br>700 for CI <300 |
| KI, integral gain = | 7 |
| IW, integrator window = | 50 |
| KE, open loop extend gain = | 1000 |
| KR, open loop retract gain = | 1000 |

At maximum rate a loop error of approximately 100 bits will saturate the stepper motor (±1,535 microsteps). Therefore, the maximum allowable loop error, EE, is set at 100. Position errors exceeding EE will cause the pump to stop and automatically restart.

All of the values for the FIG. 6 implementation are given in the following table:

| PARAMETERS | |
|---|---|
| CV | Velocity Bits |

-continued

| PARAMETERS | |
|---|---|
| POS | Position Bits |
| IE | Loop Error |
| KP | Proportional Gain = 1400 |
| KI | Intergral Gain = 7 |
| S | Laplace Operator, 1/sec |
| KE | Feed Forward Extend Gain = 1000 |
| KR | Feed Forward Retract Gain = 1000 |
| $K_{SV}$ | Olsen Servo Valve Gain = .0752 $\frac{in^3/s}{bit}$ at pressure drop of 1000 psi |
| $\beta$ | Hyd Fluid Bulk Modulus = 150,000 psi |
| $A_1$ | Hyd Cyl Cross-Section Area = 2.35 $in^2$ |
| L | Stroke = 8.89 inches |
| C | Dampening Factor |
| M | Reciprocating Mass = 15/386 lb $sec^2$/in |
| $K_{FE}$ | Overall F.E. Stiffness = 133,000 lb/in |
| $K_T$ | Transducer Gain = 92 bits/in |

From the foregoing, it is apparent that the present invention also provides a method of metering fluid at a selected flow rate with a pump which includes a fluid end member that is reciprocated through a pumping cycle in response to reciprocation of a power end member by a controlled volume of actuating fluid communicated to the power end member. The pumping cycle includes an extend phase during which the power end member displaces fluid across a first area and a retract phase during which the power end member displaces fluid across a second area. During this method, the position of the power end member is detected during its reciprocation. A power end member velocity and a power end member position are computed in response to the selected flow rate and in response to the relative time of the pumping cycle at which the pump is operating. The volume of actuating fluid communicated to the power end member is controlled in response to the computed velocity and position and the detected position.

In the preferred embodiment the computation of the power end member velocity and the power end member position broadly includes computing the power end member velocity and the power end member position during an extend phase using a respective set of equations (equations 21–27) for each of an acceleration portion ($t_0$–$t_1$), a constant peak velocity portion ($t_1$–$t_2$) and a deceleration portion ($t_2$–$t_3$) of an extend phase and using a predetermined extend phase acceleration factor ($a_1$) in the equations; and computing the power end member velocity and the power end member position during a retract phase using a respective set of equations (27–33) for each of an acceleration portion ($t_3$–$t_4$), a constant peak velocity portion ($t_4$–$t_5$) and a deceleration portion ($t_5$–$t_6$) of the retract phase and using a predetermined retract phase acceleration factor ($a_2$) in the equations.

The specific implementation of the preferred embodiment of the foregoing steps of the method are apparent from the preceding description; therefore, they will not be repeated.

From the foregoing, the specific implementation shown in FIG. 2 provides a specified flow rate within the range from about 0.4 gpm to about 20 gpm and a tested range of from about 0.025 gpm to about 20 gpm. Other, possibly broader, flow rate ranges can be implemented using the broader concepts of the present invention which broadly relates to the closed-loop control and the profile generator techniques described herein.

Important advantages of the present invention in general are its accuracy and versatility. Closed loop control of the servo actuator automatically compensates for variation in operating pressure, hydraulic oil temperature, and hydraulic efficiency. This results in a very accurate, high rangeability for the fluid end. This occurs without the indexing problem common to slow speed rotary motors. The output flow rate from the pump can be made essentially constant because the liquid end is double-acting. The microprocessor-based controller can be programmed to compensate for the acceleration and deceleration ramps in the flow rate profile so that the average flow rate remains constant. Further, the acceleration and deceleration rates can be changed to allow for different fluid end operating conditions and prevent loss of prime and/or valve leakage. The microprocessor-based controller can also be programmed to compensate for liquid end flow calibration errors caused by unswept volume, air entrainment in the pumped fluid, valve leakage, etc. Positive sealing maintains high volumetric efficiency over a wide range of flows, pressures and viscosities. Positive sealing also gives superior suction characteristics.

In conclusion, the present invention in its preferred embodiment provides a microprocessor-controlled, positive displacement metering pump which is more accurate, has greater rangeability (turn-down ratio) and is more versatile than existing metering pumps known to me.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

APPENDIX

The first order differential equation describing the flow rate, Q, through a lumped series fluid inertance and resistance system can be obtained by summing the pressure drops across the fluid inertance, $L_f$, and the fluid resistance, $R_f$.

$$\Delta P_L + \Delta P_R = P_2 - P_1 = \Delta P \quad \text{(A1)}$$

$$L_f \frac{dQ}{dt} + R_f Q = P_2 - P_1 = \Delta P$$

To prevent cavitation, $P_1$ must be greater than the fluid vapor pressure, $P_{vap}$. For the condition of incipient cavitation:

$$P_1 = P_{vap}$$

$P_2$ is the total static head on the suction system:

$$P_2 = P_{atm} + \rho H$$

where, $\rho$ = fluid density

H = height of reservoir with respect to pump piston centerline

The fluid inertance, $L_f$, is:

$$L_f = \rho \frac{L}{A}$$

where,

L=length of suction piping

A=cross-section area of suction piping.

In units of inches, pounds, and seconds, $L_f$ is given by:

$$L_f = \frac{\gamma L}{8395 D_P^2}$$

where, $\gamma$=Specific gravity $D_P$=Suction pipe diameter, inches

The fluid resistance, $R_f$ is the sum of the piping flow resistance, $R_P$, and the suction valve chamber flow resistance, $R_v$. The piping flow resistance is given by:

$$R_P = \frac{\gamma f Q L}{13186\ D_P^5}$$

where, f=friction fractor

Q=flow rate, $in^3/s$

The friction factor, f, is given by:

$$\text{if } RE < 3000\ f = \frac{64}{Re}$$

if Re>3000 f=0.0056+0.5(Re)−.32 The Reynold's number, Re, is given by:

$$\frac{645\ V\ D_P \gamma}{\mu}$$

where,

V=fluid velocity in suction piping, in/s $\mu$=absolute viscosity, cP

The absolute viscosity, $\mu$, for a pseudol-plastic fluid is given in terms of the rheological parameters n' and k'.

$$\mu = 47880\ k'(\delta)^{n'-1}$$

where, $\delta$=shear rate of flow, $sec^1$

For pipe flow the shear rate, $\delta$, is given by, $$\delta = \frac{8V}{D_P}$$

The suction valve chamber flow resistance is given by, $$R_v = \frac{\gamma \Gamma Q}{13186 D_v^4}$$

where, $D_v$=Ball valve throat diameter, inch $\Gamma$=Ball valve flow resistance coefficient The flow resistance coefficient, $\Gamma$, was experimentally determined by A. Vetter and H. Fritsch ("The Design and Layout of Pipelines for Oscillating Reciprocating Pumps," American-Lewa Paper #D10-102a) for a fully opened ball valve without a spring.

For, $$1 < Re_v < 140;\ \log \Gamma = -\log Re_v + 3$$

$$Re_v > 140;\ \Gamma = 7$$

where, $Re_v$=Reynold's number based on valve throat diameter $D_v$.

Substituting the foregoing into Equation A1 gives the differential equation describing the flow rate, Q, through the suction system as a function of time.

$$\left(\frac{\gamma L}{8395 D_P^2}\right)\frac{dQ}{dt} + \left(\frac{\gamma f Q L}{13186 D_P^5} + \frac{\gamma \Gamma Q}{13186 D_V^4}\right) Q = P_{atm} + \rho H - P_{vap}$$

This equation was solved numerically using DYSIMP. The model results show that when pumping LGC-5 at 20 gpm, full suction flow of 158 $in^3/s$ is achieved in 0.126 seconds. To give adequate operating margin, a velocity ramp time, $t_r$, of 0.180 seconds at 20 gpm was specified.

What is claimed is:

1. An apparatus for pumping a fluid at a selected flow rate, comprising:

fluid end means for receiving and discharging the fluid;

power end means, connected to said fluid end means, for operating said fluid end means;

fluid communicating means for communicating a variable amount of an actuating fluid to said power end means;

position detecting means for sensing a position of said power end means and for providing a signal in response thereto; and control means, responsive to said signal from said position detecting means and to a set point signal designating the selected flow rate, for operating said fluid communicating means to communicate actuating fluid to said power end means so that said power end means operates said fluid end means to discharge at the selected flow rate the fluid received in said fluid end means, said control means including computer means for computing a velocity value and a position value in response to said selected flow rate and for processing said velocity value, said position value and said signal from said position detecting means in response to a predetermined closed loop proportional gain, a predetermined closed loop integral gain and a predetermined open-loop feed-forward loop gain to produce a signal for operating said fluid communicating means.

2. An apparatus as defined in claim 1, wherein said fluid end means includes a double-acting piston.

3. An apparatus as defined in claim 1, wherein said power end means includes a double-acting piston.

4. An apparatus as defined in claim 1, wherein said fluid communicating means includes a servo valve having a stepper motor responsive to said control means.

5. An apparatus as defined in claim 1, wherein said position detecting means includes a magnetostrictive position transducer connected to said power end means and said control means.

6. An apparatus as defined in claim 1, wherein said computer means includes a programmed microcomputer.

7. An apparatus as defined in claim 1, wherein:

said fluid end means includes:

a fluid end cylinder; and a fluid end piston disposed for reciprocating movement in said fluid end cylinder;

said power end means includes:

a power end cylinder including two ports; and a power end piston disposed for reciprocating movement in said power end cylinder and connected to said fluid end piston;

said fluid communicating means includes a servo valve having two ports for communicating with a source of the actuating fluid and further having two ports connected to said two ports of said power end cylinder;

said position detecting means includes a position transducer connected to said power end cylinder; and said computer means includes a microcomputer connected to respond to said position transducer and to operate said servo valve.

8. An apparatus as defined in claim 1, wherein said computer means provides means for controlling said fluid communicating means so that said power end means operates said fluid end means to discharge the fluid within a range between a low discharge flow rate and a high discharge flow rate, wherein the ratio between the high discharge flow rate and the low discharge flow rate is about 800:1.

9. An apparatus as defined in claim 1, wherein said computer means provides means for controlling said fluid communicating means so that said power end means operates said fluid end means to discharge the fluid within a range between about 0.025 gallons per minute and about 20.0 gallons per minute.

10. An apparatus for operating a pump which includes a movable member whose position correlates with the fluid output of the pump, said apparatus comprising:

means for receiving a set point signal designating a selected average flow rate at which fluid is desired to be output by the pump;

means for receiving a pump feedback signal designating the position of the movable member of the pump;

velocity and position profile generator means for generating a velocity signal and a position signal in response to said set point signal; and means for generating, in response to said velocity signal, said position signal and said pump feedback signal, a pump operation control signal.

11. An apparatus as defined in claim 10, further comprising fluid communicating means for communicating actuating fluid to the pump in response to said pump operation control signal.

12. An apparatus as defined in claim 11, further comprising position transducer means, responsive to the movable member of the pump and connected to said means for receiving said pump feedback signal, for generating said pump feedback signal.

13. An apparatus as defined in claim 10, wherein said velocity and position profile generator means includes means for computing a velocity value and a position value in response to a predetermined acceleration value and for outputting said velocity signal and said position signal in response thereto.

14. A method of operating a pump which includes a movable member whose position correlates with the fluid output of the pump, said method comprising the steps of:

(a) designating a selected flow rate at which fluid is desired to be output by the pump;

(b) identifying the position of the movable member of the pump;

(c) generating a velocity value and a position value in response to the designated flow rate; and (d) generating in response to the velocity value, the position value and the position of the movable member of the pump, a pump operation control signal.

15. A method as defined in claim 14, wherein said step (c) includes computing the velocity value and the position value in response to a predetermined acceleration value.

16. A method of metering fluid at a selected flow rate with a pump which includes a fluid end member that is reciprocated through a pumping cycle in response to reciprocation of a power end member by a controlled volume of actuating fluid communicated to the power end member, which pumping cycle includes an extend phase during which the power end member displaces fluid across a first area and a retract phase during which the power end member displaces fluid across a second area, said method comprising the steps of:

(a) detecting the position of the power end member during its reciprocation;

(b) computing a power end member velocity and a power end member position in response to the selected flow rate and in response to the relative time of the pumping cycle at which the pump is operating; and (c) controlling, in response to the computed velocity and position and the detected position, the volume of actuating fluid communicated to the power end member.

17. A method as defined in claim 16, wherein said step (b) includes:

computing the power end member velocity and the power end member position during an extend phase using a respective set of equations for each of an acceleration portion, a constant peak velocity portion and a deceleration portion of an extend phase and using a predetermined extend phase acceleration factor in the equations; and computing the power end member velocity and the power end member position during a retract phase using a respective set of equations for each of an acceleration portion, a constant peak velocity portion and a deceleration portion of the retract phase and using a predetermined retract phase acceleration factor in the equations.

* * * * *

UNITED STATES PATENT AND TRADEMARK OFFICE

CERTIFICATE OF CORRECTION

PATENT NO. : 4,990,058

DATED : February 5, 1991

INVENTOR(S) : David M. Eslinger

It is certified that error appears in the above-indentified patent and that said Letters Patent is hereby corrected as shown below:

In column 10, line 48, delete [$t_r$] and insert therefore --$t_r^e$--.

In column 11, line 7, delete [$t_r$] and insert therefore --$t_r^r$--.

In column 17, line 48, delete [$sec^1$] and insert therefore -- $\frac{1}{sec}$ --.

Signed and Sealed this

Twenty-sixth Day of July, 1994

*Attest:*

*Attesting Officer*

BRUCE LEHMAN

*Commissioner of Patents and Trademarks*